United States Patent [19]

Ito

[11] Patent Number: 5,024,154

[45] Date of Patent: Jun. 18, 1991

[54] TRANSFER ROLLER SWITCHING MECHANISMS OF INK AND WATER SUPPLY APPARATUS FOR USE IN PRINTING PRESSES

[75] Inventor: Kiyoshi Ito, Imba, Japan

[73] Assignee: Komori Printing Machinery Co., Ltd., Tokyo, Japan

[21] Appl. No.: 235,421

[22] Filed: Feb. 17, 1981

[30] Foreign Application Priority Data

Feb. 28, 1980 [JP] Japan ..... 55-25054

[51] Int. Cl.[5] ..... B40L 23/00

[52] U.S. Cl. ..... 101/148; 101/350

[58] Field of Search ..... 101/148, 247, 328–331, 101/347, 350, 351, 362–363, 144, 145

[56] References Cited

U.S. PATENT DOCUMENTS

| | | | |
|---|---|---|---|
| 2,083,542 | 6/1937 | Barber | 101/350 |
| 2,162,812 | 6/1939 | Harrold et al. | 101/351 |
| 2,821,911 | 2/1958 | Mestre | 101/148 |
| 3,030,884 | 4/1962 | Lindemann | 101/247 |
| 3,067,674 | 12/1962 | Tyma, Jr. et al. | 101/247 X |
| 3,412,676 | 11/1968 | Tonkin et al. | 101/148 X |
| 3,521,560 | 7/1970 | Schmidlin et al. | 101/148 X |
| 3,552,312 | 1/1971 | Schinke | 101/148 |
| 3,688,696 | 9/1972 | Treff | 101/148 X |
| 3,858,508 | 1/1975 | Kaneko et al. | 101/148 X |
| 3,965,819 | 6/1976 | Punater | 101/350 |

FOREIGN PATENT DOCUMENTS

| | | | |
|---|---|---|---|
| 1241581 | 8/1971 | United Kingdom | 101/350 |

*Primary Examiner*—E. H. Eickholt

*Attorney, Agent, or Firm*—Charles E. Pfund

[57] ABSTRACT

In apparatus for supplying ink and or water to a plate cylinder through fountain roller, swinging roller and a transfer roller, the transfer roller is supported by a swinging lever and the motion thereof is allowed or prevented by a spring biased control member. Such allowance and prevention is selected by an operating handle.

3 Claims, 4 Drawing Sheets

TRANSFER ROLLER SWITCHING MECHANISMS OF INK AND WATER SUPPLY APPARATUS FOR USE IN PRINTING PRESSES

BACKGROUND OF THE INVENTION

This invention relates to apparatus for switching the motion of a transfer roller of an inking device and a water feed device of a printing machine in an interlocked manner with a manual operation and the operation of an impression cylinder.

A conventional rotary press comprises a number of printing units corresponding to the number of colors to be printed. FIG. 1 of the accompanying drawing shows a printing unit of a multicolor sheet fed rotary press, which comprises a plate cylinder 2, a rubber cylinder 3 which rotates in contact therewith, and an impression cylinder 4 which rotates in contact with the rubber cylinder 3. A transfer cylinder 5 is provided between adjacent printing units. Above and in front of the plate cylinder 2 are disposed an inking arrangement 6 including a plurality of roller groups and a water feed device 7 for supplying ink and water to a platen mounted on the plate cylinder 2, these forming an image which is transferred onto the surface of the rubber cylinder 3. A printing paper supplied to an paper inserting device or a printing unit of a preceding stage is clamped by jaws of the transfer cylinder 5 and wrapped about the same. The paper is then passed between the rubber cylinder 3 and the impression cylinder 4 while being clamped by the jaws thereof, during which the image on the rubber cylinder 3 is transfer-printed onto the paper. The paper thus printed is transferred to a succeeding printing unit by a transfer cylinder 5 on the downstream side or to a delivery apparatus.

The inking arrangement 6 comprises an ink fountain containing printing ink, an ink fountain roller 9, a swinging roller 10, a transfer roller 12 disposed between the ink fountain roller 9 and the swinging roller 10 and supported by a swinging arm 11. The transfer roller 12 is reciprocated between the ink fountain roller 9 and the swinging roller 10 by the arm 11 swung by the rotation of a cam not shown so as to alternately engage the peripheral surfaces of both rollers 9 and 10 thus transferring the ink on the ink fountain roller 9 to the swinging roller 10. The ink transferred to the swinging roller 10 is supplied to the platen on the plate cylinder 2 via the plurality of roller groups. Various elements of the water feed device 7 are constructed substantially identical to the elements of the inking device 6 so that corresponding elements are designated by primed reference numerals. During printing the transfer roller 12 and 12' of the inking device 6 and the water feed device 7 reciprocated between roller 9 and 10 (9' and 10'). When these transfer rollers 12, 12' are operated in the absence of printing paper between rubber cylinder 3 and the impression roller 4, ink and water would be supplied to the impression cylinder 4 thus contaminating the same causing trouble. For this reason the printing press is constructed such that, at the commencement or the interruption of the printing operation the transfer roller 12 is stopped in contact with the swinging roller 10 so as not to supply ink and water. Where it is desired to stop supply of the ink of a single color and water, the motion of the transfer roller 12 of a printing unit 1 of that color is stopped.

The rubber cylinder 3 is constructed such that it is journalled by eccentric bearings and at the time of off-printing by rotating the bearings the peripheral surface of the rubber cylinder 3 is separated from the plate cylinder 2 and the impression cylinder 4 so as to switch from the so-called cylinder-in state to the cylinder-out state. As above described during the off-printing state, as it is necessary to stop supply of water and ink and to bring the rubber cylinder 3 to the cylinder-out state it is desirable to interlock the switching operation between operation and stop of the transfer roller with the in and out operations of the rubber cylinder 3 in order to simplify the operation. However, if the interlocking were made constantly, where it is desired to stop supply of ink and water for only one color, a cylinder-out state would be resulted thus disabling paper feed. Accordingly, it is necessary to make independent from each other the switching operation of the transfer roller 12 and the switching operation of the cylinder in and out operation of the rubber cylinder 3.

SUMMARY OF THE INVENTION

It is an object of this invention to provide a transfer roller switching mechanism of ink and or water supply apparatus for use in a printing press capable of manually switching the reciprocating motion and stop of the transfer roller whether a plate cylinder is in contact with or separated from a rubber cylinder.

Another object of this invention is to provide a transfer roller switching mechanism capable of readily and rapidly commence and stop supply of ink and or water for various printing operations.

According to this invention there is provided a transfer roller switching mechanism of ink or water supply apparatus for use in a printing press comprising fountain roller for supplying ink or water, a swinging roller for supplying ink or water to a plate cylinder, a rubber cylinder brought into engagement with the plate cylinder and out of engagement therefrom, a transfer roller reciprocated between the fountain roller and the swinging roller, a swinging arm which is swung together with a supporting member of the transfer roller, a control member pivoted to the swinging lever near a free end thereof and interlocked with movements of the rubber cylinder into engagement and disengagement from the rubber cylinder so as to prevent swinging motion of the swinging lever, manual switching means for switching the control member between a position at which the movement of the swinging lever is prevented and a position at which the swinging lever is permitted to move, and buffer spring means interposed between the plate cylinder and the control member for transmitting motion therebetween and for enabling the rubber cylinder to disengage from the plate cylinder when the control member is fixed.

DESCRIPTION OF THE PREFERRED EMBODIMENT

Figure 1:
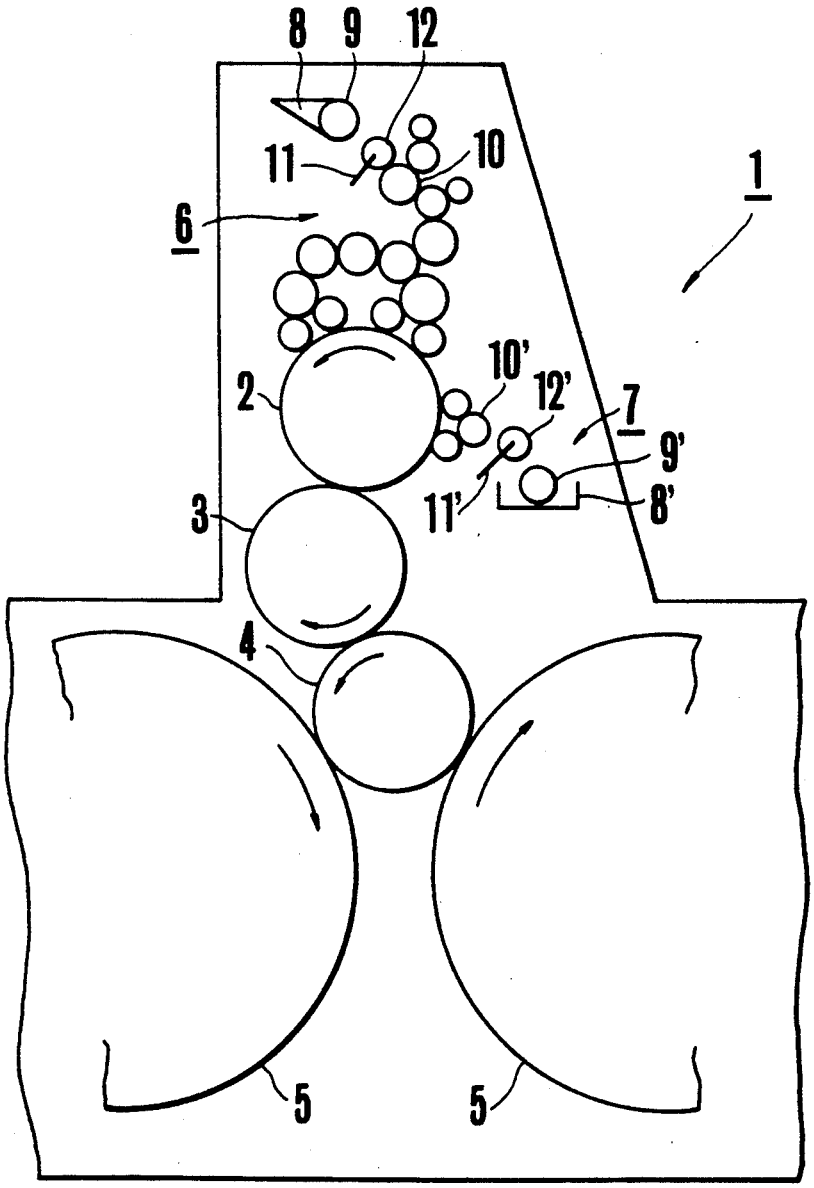
FIG. 1 (PRIOR ART)
FIG. 1 is a diagrammatic side view of a prior art multicolor sheet fed rotary press.

FIGS. 2, 3 and 4*a* through 4*d* show one embodiment of this invention as applied to a multicolor sheet fed rotary press provided with a plurality of printing unit as shown in FIG. 1. As shown, a take out shaft 22 is rotatably supported by a frame 21 between the ink fountain roller 9 which is rotated at a low speed in contact with the ink contained in the ink fountain 8 disposed at an upper position of the printing unit 1, and the swinging roller 10 journalled by the frame 21 and rotated at the same high speed as the peripheral speed of the plate cylinder 2. The transfer roller 12 is rotatably supported by the upper end of the swinging arm 11 which is pivotally connected to the take out shaft 22 to act as a supporting lever of the transfer roller 12, and a cam lever 23 is fixed to one end of the take out shaft 22 extending beyond the frame 21. A cam shaft 24 is journalled by the frame 21 beneath the take out shaft 22. A sprocket 26 and a cam 27 which rotate synchronously with the plate cylinder 2 are secured to the opposite ends of a cylindrical cam support 25 rotatably mounted on the cam shaft 24. The cam 27 has a cam surface including a high portion 27*a* and a low portion 27*b* and the cam surface engages against a cam follower 28 mounted on the outer end of the cam lever 23, one end thereof being biased by a compression spring 29 with one end supported by the frame 21 to urge the cam follower 28 against the cam surface. On the side of the swinging roller 10 opposite to the shaft 22 is provided a shaft 30 with both ends supported by the frame 21 and a panel 31 and a circular disc 32 is secured to the shaft 30 close to the frame 21. Long and short pins 33 and 34 are secured to the outer side surface of the disc 32 at a relative angle of about 70°. The periphery of the disc 32 is provided with three notches 35, 36 and 37 at a spacing of about 70°. A click spring 38 is mounted on the frame 21 to selectively engage either one of the notches as the disc 32 is rotated for arresting the rotation thereof. An actuating member 42 in the form of a cylinder 39 provided with an arm 40 at one end and a main body 41 at the other end is rotatably mounted on the shaft 30 with the main body 41 positioned adjacent the boss of the disc 32. The main body 41 of the actuating member 42 takes the form of a rectangle and is provided with a projection 41*a* adapted to engage longer pin 33 and a notch 41*b* on its side opposite the projection 41*a*. To the shaft 22 is secured a swinging lever 43 which swings integrally with the swinging arm 23, the outer end of the swinging lever 43 extending into a space between the disc 32 and the main body 41. A pin 44 adapted to engage the notch 41*b* is secured to the outer end of the swinging lever 43. When engaged with the swinging lever 43, the shorter pin 34 prevents the lever 43 from swinging. An operating handle 45 is secured to the outer end of shaft 30 with a resilient washer 45 interposed between the handle 46 and the panel 31.

An eccentric bearing 47 having an axis of rotation F (see FIG. 2) is journalled by the frame 21 between the impression cylinder 4 and the plate cylinder 2. The bearing 47 rotatably supports the rubber cylinder 3 having axes of rotation at points F1, F2 ..., eccentric with the respect to point F. At the time of printing, as shown by a solid line in FIG. 2, the periphery of the rubber cylinder 3 is brought into contact with the plate cylinder 2 to print paper inserted therebetween, whereas at the time of off printing, the axis of rotation of the rubber cylinder 3 is shifted from point F1 to point F2 by rotating the eccentric bearing 47 so as to separate the rubber cylinder 3 from the plate cylinder 2 as shown by dot and dash lines. The end surface of the rubber cylinder 3 is connected to the arm 40 through a connecting rod 48. More particularly, one end of the connecting rod 48 is pivotally connected to the end surface of the rubber cylinder 3 through a pivot pin 49*a*, while the other end is slidably received in a square block 49*a* rotatably mounted on the free end of the arm 40. Cushion springs 52 and 53 are disposed between the square block 49 and collars 50 and 51 secured to the connecting rod 48 for urging the square block 49 from opposite sides.

Figure 4A:
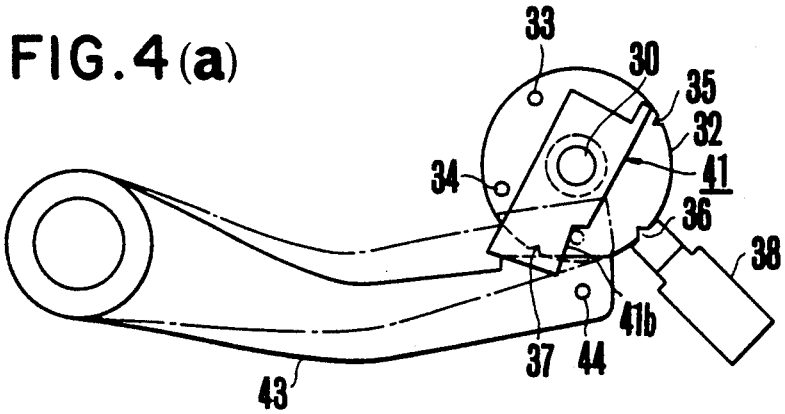
FIGS. 4*a* through 4*d* are side views explaining the operation of the roller switching apparatus.

The roller switching mechanism described above operates as follows. At the time of printing, the axis of the rubber cylinder 3 is maintained at point Fl and its periphery is urged against the plate cylinder 2 and the impression cylinder 4 so as to apply pressure to printing paper passing through the rubber cylinder 3 and the plate cylinder 2. Accordingly to the position of the rubber cylinder 3, the connecting rod 48 is positioned at a position shown by solid lines in FIG. 2 whereby the connecting rod 48 urges the arm 40 to rotate in the clockwise direction as viewed in FIG. 2 via buffer springs 51 and 52 so that the main body 41 integral with the arm 40 is inclined as shown in FIG. 4*a*. Rotation of cam 27 swings the swinging arm 11 and the swinging lever 43 as an integral unit so as to reciprocate the transfer roller 12 between the ink fountain roller 9 and the swinging roller 10 thus transferring the ink on the roller 9 onto the swinging roller 10. At this time, the main body 1 is in the inclined position so that its notch 41*b* faces pin 44 of the swinging arm 43. As shown by solid lines and dot and dash lines in FIG. 4*a*, the movement of the swinging lever 43 is not interfered by the main body 41 so that the swinging motion of the transfer roller 12 is continued.

Figure 2:
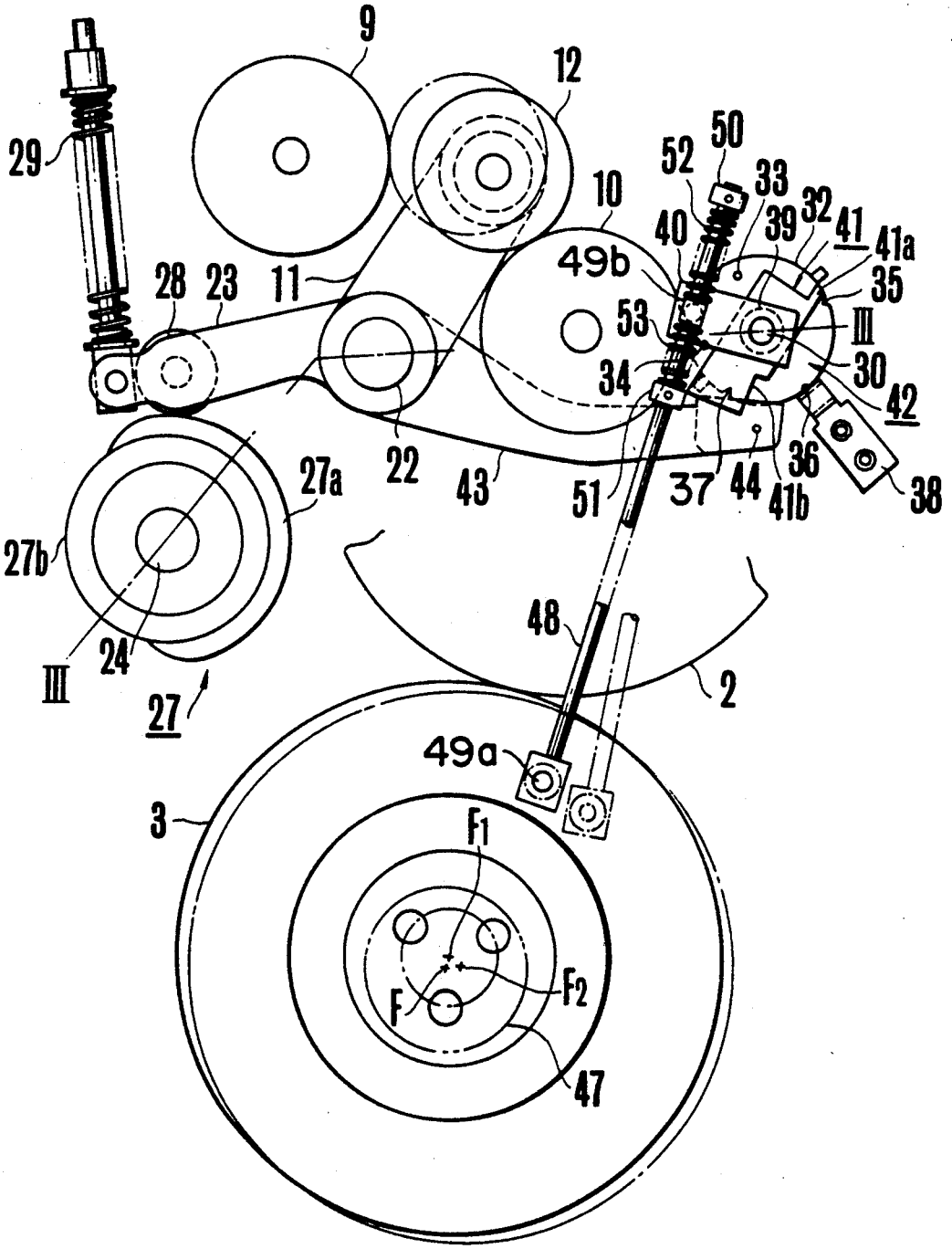
FIG. 2 is a side view of a roller switching mechanism embodying the invention for use in the ink and water supply apparatus of a printing press.
Figure 3:
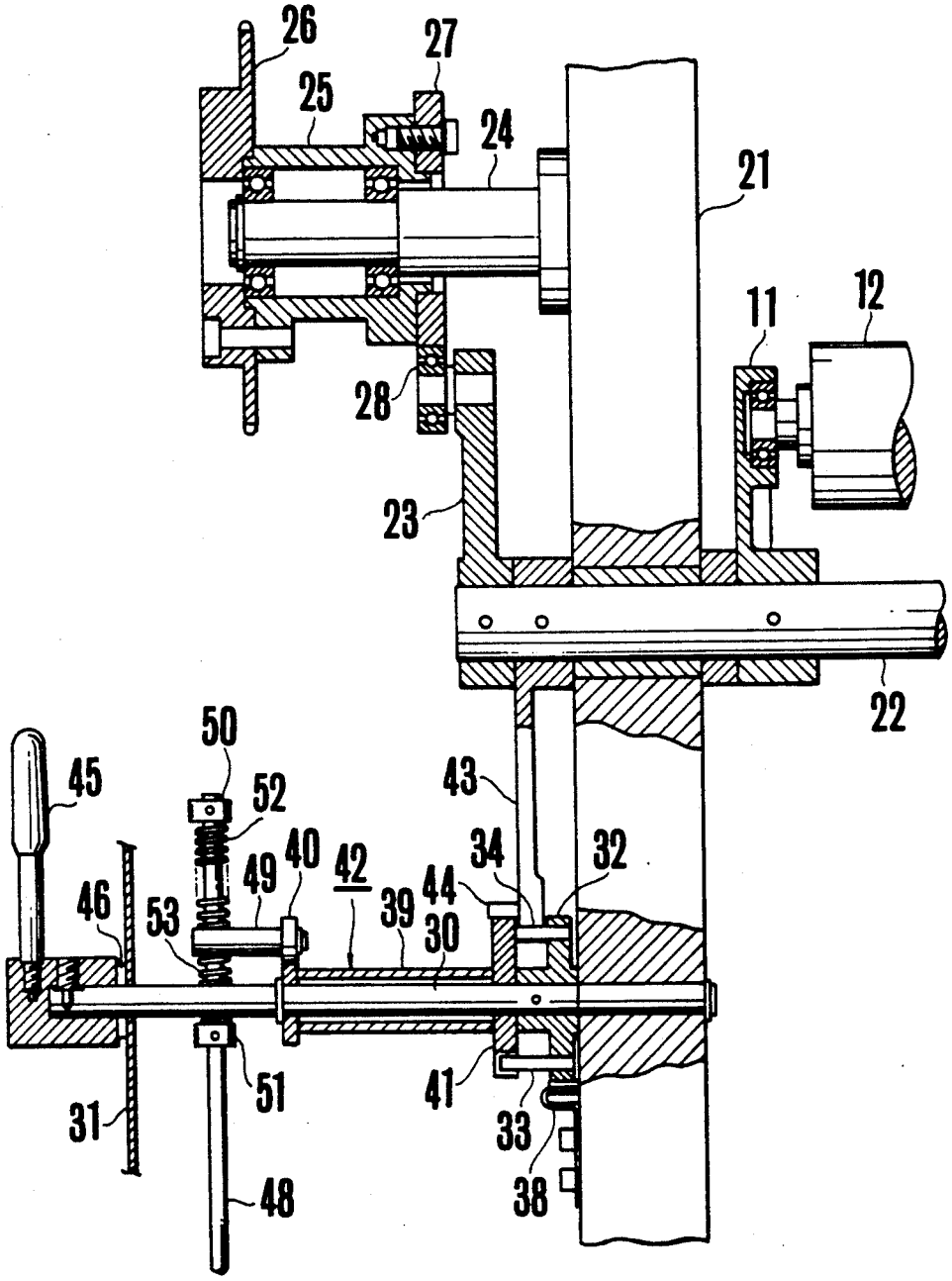
FIG. 3 is a sectional view taken along a line III—III shown in FIG. 2.
Figure 4B:
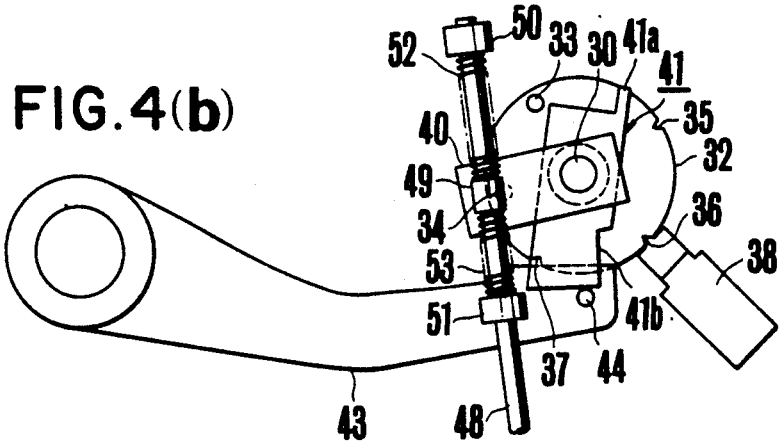
Figure 4C:
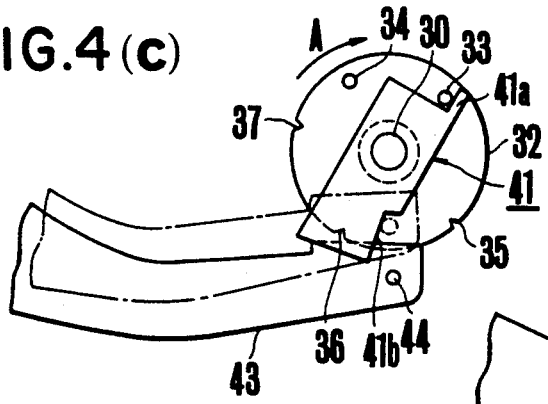
Figure 4D:
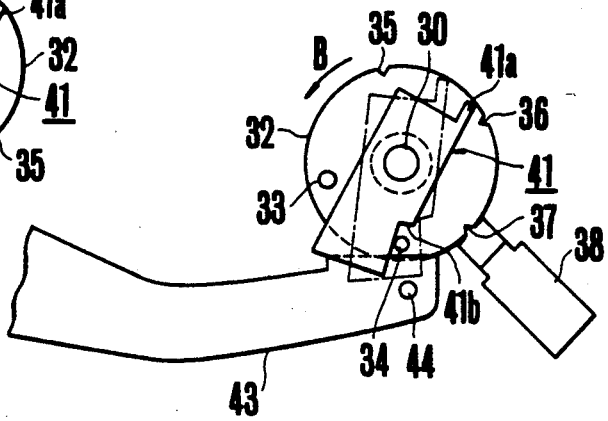

To stop the printing operation, the eccentric bearing 47 of the rubber roller cylinder 3 is rotated in the clockwise direction as viewed in FIG. 2 to shift the axis of the rubber cylinder 3 from F1 to F2 to separate the rubber cylinder 3 from the plate cylinder 2 while at the same time the pivot 49*a* of the connecting rod 48 moves to a dot and dash position. As a consequence, as shown in FIG. 4*b*, the connecting rod 48 rotates arm 40 in the counterclockwise direction to bring the main body 41 to a substantially vertical position. Then the portion of the main body 41 not formed with a notch engages pin 44 thus locking the swinging lever 43. At this time the transfer roller 12 is stopped in contact with the swinging roller 10 thereby interrupting the supply of the ink. Also at this time while the rubber cylinder 3 is separated from the plate cylinder, that is when printing is not made, the main body 41 tends to rotate while the pin 44 is engaging with the notch 41*b*, the buffer springs 52 and 53 firstly moves the connecting rod 48 to elect the actuating member 42 after the transfer roller 12 has engaged the swinging roller 10 thus preventing the movement of the swinging lever 43.

Reciprocation and stopping of only the transfer roller 12 irrespective whether the rubber cylinder 3 is engaging or disengaging from the plate cylinder will now be described. Thus, the disc 32 is rotated in a direction of arrow shown in FIG. 4*c* with the handle 45 to cause pin 33 to engage projection 41*a* of the operating member 41 to rotate the same in the clockwise direction. Then the click spring 38 engages the notch 35 of the disc 32 to prevent rotation of the disc 32. Accordingly, the swinging lever 43 is free to swing in the same manner as in the state shown in FIG. 4*a* so that the transfer roller 12 is reciprocated according to the rotation of the cam 27. At this time, even when the connecting rod 48 slides while actuating member 42 is being prevented from rotating, the movement of the connecting rod 48 is absorbed by the cushion springs 52 and 53 so that engagement and disengagement of the rubber cylinder 3 to and from the plate cylinder 2 would not be interfered. When the disc 32 is rotated in a direction of arrow b shown in FIG. 4, the shorter pin 34 comes to oppose the upper surface of the end of the swinging lever 43 after passing through a space between the main body 41 and disc 32 so that the click spring 38 engages the notch 37 of the disc 32 to stop the rotation of the disc 32. Consequently, the swinging motion of the swinging lever 43 is prevented by the pin 34 with the result that the transfer roller 12 is stopped at a postion opposing the swinging roller 10. While the transfer roller 12 is situated near the ink fountain 8, rotation of the disc 32 causes pin 34 to press down the upper surface of the swinging arm 43 so that the transfer roller is moved toward the swinging roller 10. Under these conditions when the rubber cylinder 3 is engaged or disengaged from the plate cylinder 2 since the actuating member 42 is rotatable as shown by solid and dotted lines in FIG. 4*d*, it does not interfere with the operation of the transfer roller 12.

While in the foregoing, a transfer roller switching mechanism of an inking device 6 has been described, a transfer roller switching mechanism of the same construction is also provided between the transfer roller 12' and the plate cylinder 2 for the water feed apparatus 7 to operate synchronously with the switching mechanism of the ink fountain.

As above described according to this invention, in ink and water supply apparatus of a printing press, a rotatable control member and manual switching means thereof are provided near the free end of a swinging lever which swings as a transfer roller reciprocates, and buffer spring means is provided between the control member and the plate cylinder, so that it is possible not only to interlock the reciprocation and stopping of the transfer roller with engagement and disengagement of the plate cylinder to and from a rubber cylinder but also to manually switch the reciprocation and stop of the transfer roller whether the plate cylinder engages the rubber cylinder or not. Accordingly, it is possible to readily and rapidly supply or not ink and water for such various operating states of the press as the commencement of the printing, stop of supply of ink and water for one color at the time of multicolor printing. Moreover as the construction is compact and utilizes lesser number of component parts, not only the occupation space is small but also maintenance is easy.

What is claimed is:

1. A transfer roller switching mechanism of ink and/or water supply apparatus for use in a printing press comprising a fountain roller for supplying ink or water, a swinging roller for supplying ink or water to a plate cylinder, a rubber cylinder brought into engagement with said plate cylinder and out of engagement therefrom, a transfer roller reciprocated between said fountain roller and said swinging roller, a swinging lever which is swung together with a supporting member of said transfer roller, a control member pivoted to said swinging lever near a free end thereof and interlocked with movements of said rubber cylinder into engagement and disengagement from said rubber cylinder so as to prevent swinging motion of said swinging lever, manual switching means for switching said control member between a position at which the movement of said swinging lever is prevented and a position at which said swinging lever is permitted to move, and buffer spring means interposed between said plate cylinder and said control member for transmitting motion therebetween and for enabling said rubber cylinder to disengage from said plate cylinder when said control member is fixed.

2. The mechanism according to claim 1 wherein said control member comprises a disc interlocked with said swinging lever, a rectangular member 41 driven by said disc, and a lever 49 interposed between said spring means and said rectangular member.

3. The mechanism according to claim 2 which further comprises an operating handle for rotating said disc.

* * * * *